United States Patent [19]

Mahieu

[11] 4,198,615

[45] Apr. 15, 1980

[54] FULL RANGE CURRENT LIMITING FUSE HAVING HIGH LOAD CURRENT CARRYING CAPACITY

[75] Inventor: William R. Mahieu, Centralia, Mo.

[73] Assignee: A. B. Chance Company, Centralia, Mo.

[21] Appl. No.: 875,352

[22] Filed: Feb. 6, 1978

[51] Int. Cl.[2] ..... H01H 85/04; H01H 85/12

[52] U.S. Cl. ..... 337/162; 337/292

[58] Field of Search ..... 337/158, 159, 160, 161, 337/162, 284, 283, 286, 293, 292

[56] References Cited

U.S. PATENT DOCUMENTS

| | | | |
|---|---|---|---|
| 3,304,387 | 2/1967 | Lindell | 337/162 |
| 3,304,388 | 2/1967 | Lindell | 337/162 |
| 3,304,389 | 2/1967 | Lindell | 337/162 |
| 3,304,390 | 2/1967 | Lindell | 337/162 |
| 3,611,239 | 10/1971 | Kozacka | 337/162 |

*Primary Examiner*—Harold Broome

*Attorney, Agent, or Firm*—Schmidt, Johnson, Hovey & Williams

[57] ABSTRACT

A current limiting fuse is provided with a number of discrete current limiting elements coupled electrically in parallel between a pair of conductive terminals, and a fused gap assembly in series with each current limiting element whereby full range fault current protection is provided by the fuse. Under the influence of high range fault currents, the current limiting elements operate collectively to quickly clear the fault, while low fault currents are interrupted by fusing of the fused gaps to present a plurality of parallel arc gaps in the elements, which parallel gaps function in turn to sequentially distribute the full fault to each element resulting in successive interruption by the elements and ultimate clearing of the low range fault. In a second form of the invention shiftable contact sets in each element are operably coupled with a low fault current responsive device to create the arc gaps required for sequential operation of the current limiting elements.

19 Claims, 8 Drawing Figures

FULL RANGE CURRENT LIMITING FUSE HAVING HIGH LOAD CURRENT CARRYING CAPACITY

This invention relates to current limiting fuses in general, and particularly concerns a full range current limiting fuse having reliable current-distributing structure operable to dependably interrupt low fault currents.

BACKGROUND

Current limiting fuses have long been used in the protection of electrical distribution systems. Generally, these fuses comprise a fusible element of varying cross section surrounded by finely divided refractory material.

Current limiting fuses are extremely well suited for interrupting high range fault currents inasmuch as such fuses significantly reduce energy dissipation during fault clearance. In advanced designs, a silver fusible element having a plurality of zones of reduced cross section is employed, the zones of the element being rapidly vaporized upon experiencing a fault current such that arcing occurs across each of the spaces formerly occupied by the reduced cross section zones. This multiple arcing continues at a rapid rate until sufficient arc resistence is generated to present aggregate voltage drops exceeding the normal system voltage whereupon the fuse current is forced to zero long before the peak value of the available fault current is obtained. The refractory material surrounding the silver element forms a glassy matrix which entraps the silver vapor in order to preclude restriking of the arc.

The primary advantage of current limiting fuses over other fuse devices is their ability to limit energy dissipation and contain all energy of interruption thereby operating in a totally nonviolent manner even in response to very high fault currents. Thus, current limiting fuses offer effective highly dependable protection against the deleterious effect of high fault currents. Moreover, current limiting fuses may be safely and advantageously used in areas where violent fuse operation would prove annoying or even hazardous.

One problem common in even the most advanced current limiting fuse designs is that of providing reliable protection against a full range of fault currents. In this regard, current limiting fuses inherently generate arc resistance at a rate which increases with the magnitude of the fault current; consequently, high range fault currents are interrupted more rapidly than low range fault currents. This characteristic presents a design dilema inasmuch as the fuse must be capable of generating arc resistence slowly enough to avoid generation of excessive peak arc voltages under high fault current conditions, while at the same time the fuse must be able to generate arc resistence fast enough under low fault conditions to interrupt the fault before the supply of refractory material is exhausted by heating from the arc. These competing opposed design considerations have seriously frustrated attempts to produce a full range current limiting fuse.

Numerous efforts have been made to develope a true full range current limiting fuse, the simplest being the use of so called "M spot" elements. The "M spot" elements are hybrids, comprising a conventional silver element provided with a section of low melting point metal for the purpose of interrupting low fault currents.

However, current limiting fuses of this design are subject to thermal degradation sometimes resulting in melting of the element and subsequent arcing at a current below the rated current of the fuse, thereby permitting sustained arcing and ultimate rupture of the fuse housing. Of course, such operation is simply not acceptable in view of the service demands made upon today's utility companies.

A more sophisticated approach to the above mentioned problem is disclosed in U.S. Pat. No. 3,304,387 issued to Lindell and entitled "Current Limiting Fuse Having Parallel Current Limiting Elements In A Series Connected Current Calibrated Element With Auxiliary Arc Gaps To Blow The Current Limiting Elements One By One". The Lindell device employs a number of parallel current limiting elements designed to collectively carry the rated current of the fuse and effectively interrupt high magnitude fault currents, and a means for distributing the full fuse current to each element individually upon encountering a low magnitude fault current. Lindell accomplishes current distribution by the provision of a current calibrated fusible element connected in series with the current limiting elements through extensions on each respective element. A series of arc gaps, one for each current limiting element, is coupled in parallel with the fusible element in order to provide sequential distribution of current to the individual current limiting elements upon fusing of the fusible elements and extensions. In this manner, the current limiting elements are successively fused under the influence of the low fault current until the fault current is cleared upon fusing of the last current limiting element. One problem with this device is that of extinguishing the rather stable single arc, formed upon fusing of the fusible element, in order to initiate sequential arcing of the gaps in the current limiting elements. Lindell proposes several different mechanisms in an attempt to accomplish satisfactory extinguishment of the initially formed single arc as in U.S. Pat. Nos. 3,304,388, 3,304,389, and 3,304,390. However, none of these devices has proved entirely satisfactory and it is believed that the inability to provide a means for effectively and reliably extinguishing this initial arc has prevented successful commercialization of the Lindell fuse.

BRIEF SUMMARY OF THE INVENTION

In view of the problems discussed supra, the present invention offers a full range current limiting fuse having a plurality of current limiting elements electrically coupled in parallel, and means for reliably establishing parallel arc gaps in the elements in response to a low range fault current. In the preferred form, arcing across the gaps is initiated without the creation of any other arc gaps in the circuit such that the full fault current is randomly distributed successively to the current limiting elements to permit one at a time operation of the latter and consequent clearing of the low fault current.

In one embodiment of the invention, the gap-establishing means comprises a gap in each current limiting element and a corresponding number of current calibrated fusible elements shunting the respective gaps. The current calibrated elements are adapted to fuse in response to low fault currents such that the gaps in the current limiting elements are no longer shunted, each of the latter thereby being provided with an arc gap whereby current through the fuse is sequentially directed to each individual current limiting element in random succession. In this manner, the first arc formed in the current limiting fuse is across one of the parallel arc gaps in the current limiting elements. This arrangement takes advantage of the inherent instability of parallel unconstrained arcs to assure that the current is sequentially distributed to the individual current limiting elements for one at a time fusing thereof in response to the total low fault current.

In the preferred form as described above, each gap and fusible element is disposed within its own enclosed chamber to preclude the possibility of cross arcing between adjacent gaps. Further in this regard, the gaps are all disposed at one end of the current limiting elements in order to permit the utilization of a single chamber defining member.

In another form of the invention, the gap-establishing means comprises a shiftable contact set for each current limiting element, the contact sets being coupled for in unison operation and being normally disposed in the closed position. The contact sets are adapted to be operated by an external mechanism, such as a relay or fuse link triggered spring, upon encountering a low fault current. Actuation of the contact set creates the desired arc gaps in the current limiting elements such that the latter are successively operated by sequential distribution of the fault current through each element in the manner described hereinabove.

In a third form of the invention, one of the arc gaps created by the gap-establishing means is of a greater dimension than the other gaps in the fuse in order to render this gap the last to arc. By associating the larger gap with a current limiting element having a minimum interrupting current lower than the total current carrying capacity of the fuse, the remaining current limiting elements in the fuse can be substantially larger in cross section, thereby lowering the total number of fuse elements required in a fuse of given ampacity.

DETAILED DESCRIPTION

Figure 1:
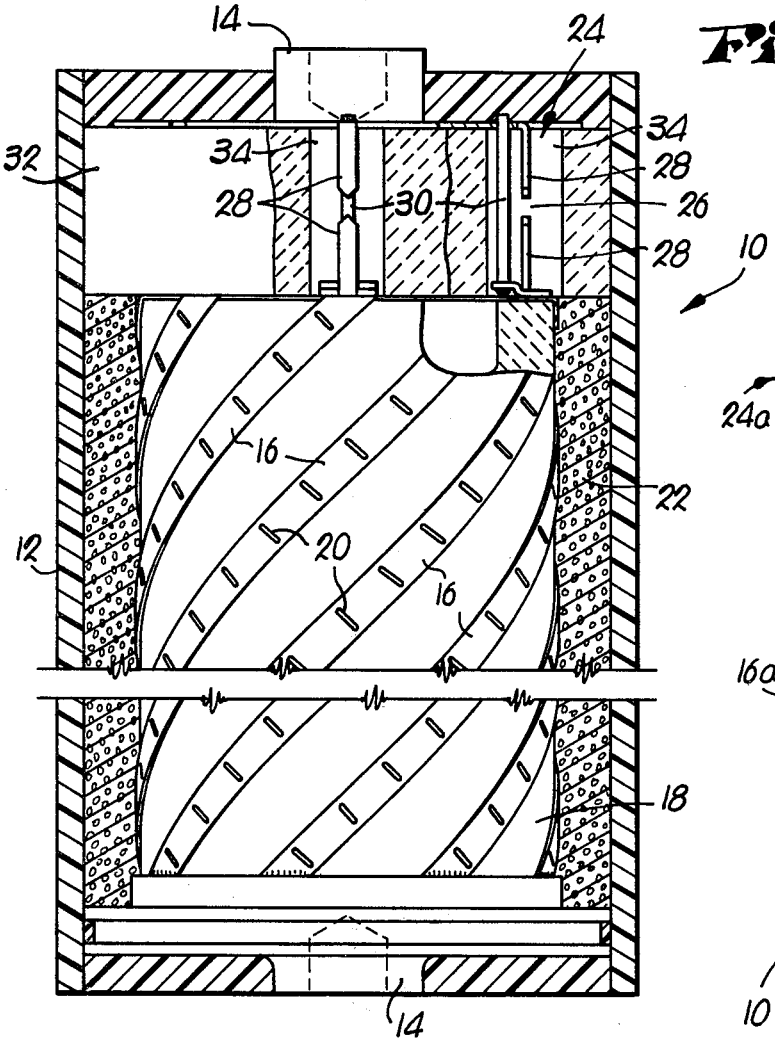
FIG. 1 is an enlarged, fragmentary, cross-sectional view showing a full range current limiting fuse constructed in accordance with the principles of the present invention.

In FIG. 1 there is shown a full range current limiting fuse 10 including a cylindrical housing 12, a pair of conductive terminals 14 at opposite ends of housing 12, and a plurality of discrete current limiting elements 16 electrically coupled in parallel between the terminals 14. Though the physical configuration of the fuse 10 is relatively unimportant, it is to be understood that the terminals 14 are adapted to be conveniently interposed within a distribution circuit in a conventional manner.

As shown in FIG. 1, the elements 16 are helically wound around a nonconductive generally cylindrical core 18 coaxially disposed within the housing 12. In preferred forms, the elements 16 are comprised of thin silver strips and have a number of spaced cutouts 20 disposed along the length thereof in order to define the required zones of reduced cross-sectional area for proper current limiting operation. Of course, there is provided a volume of granular refractory material 22, preferably silica sand, along the length of the elements 16 between the core 18 and the housing 12.

As viewed in FIG. 1, at the lower end of the fuse 10, each element 16 is brazed or otherwise suitably coupled directly to the lowermost conductive terminal 14. At the other extremity of the fuse 10, there is interposed between the uppermost terminal 14 and the upper ends of the elements 16, gap-establishing means in the form of a fused gap assembly 24 for each element 16. Each assembly 24 includes an arc gap 26 defined by a pair of spaced points 28 and shunted by a fuse element 30.

The spaced points 28 in each pair are respectively electrically coupled with the upper terminal 14 and an element 16. The shunting fuse elements 30 are of conventional construction and are preferrably fabricated of low melting point metal such as tin or the like. The fuse elements 30 are of such dimension as to fuse in response to currents within a range between a first predetermined current level greater than the minimum interruption rating of the elements 16 collectively, and a lower, second predetermined current level equal to the desired ampacity of fuse 10.

A ceramic apertured disk 32 intermediate the upper terminal 14 and core 18 defines a plurality of chambers 34 each receiving a respective assembly 24.

Figure 2:
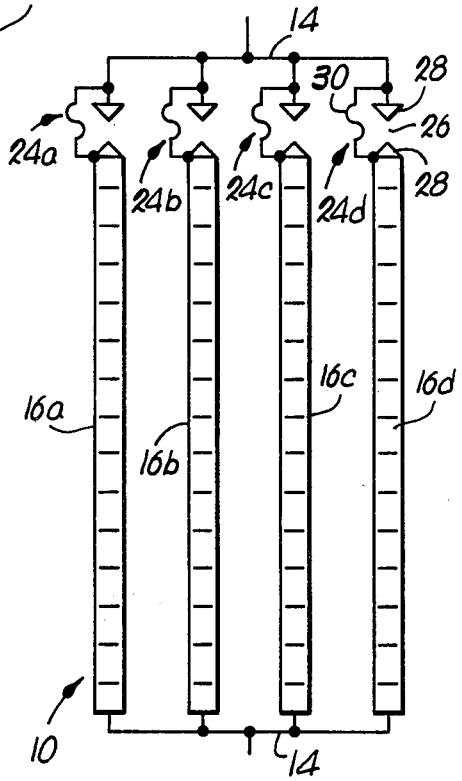
FIG. 2 is a schematic diagram of the current limiting fuse illustrated in FIG. 1.

A schematic diagram of the fuse 10 is shown in FIG. 2. Current limiting elements **16*a*, 16*b*, 16*c*, and 16*d* are disposed in parallel between terminals 14, each element 16 being coupled in series with respective fuse gap assemblies 24*a*, 24*b*, 24*c*, and 24*d*. Though only four elements 16 are shown in the schematic of FIG. 2, it is to be understood that the specific number of elements 16 required depends upon the particular design considerations of the fuse 10. In this latter regard, for a 400 amp, 15 kv class fuse in an oil environment, there would be provided sixteen current limiting elements 16 each having a width of approximately 0.250 inches and a thickness of 0.0035 inches. Additionally, the 15 kv class fuse would have arc chambers 34 of 0.500 inches in diameter, gaps 26 of 0.125 inches in length, and fuse elements 30** of 0.073 inches diameter wire approximately 1 inch long.

The basic design consideration is that the elements 16 collectively must be capable of conducting the rated current of the fuse 10 but at the same time individually have a minimum interrupting rating which is less than the rating of the fuse 10 in order to assure interruption of sequentially distributed low fault currents.

Figure 8:
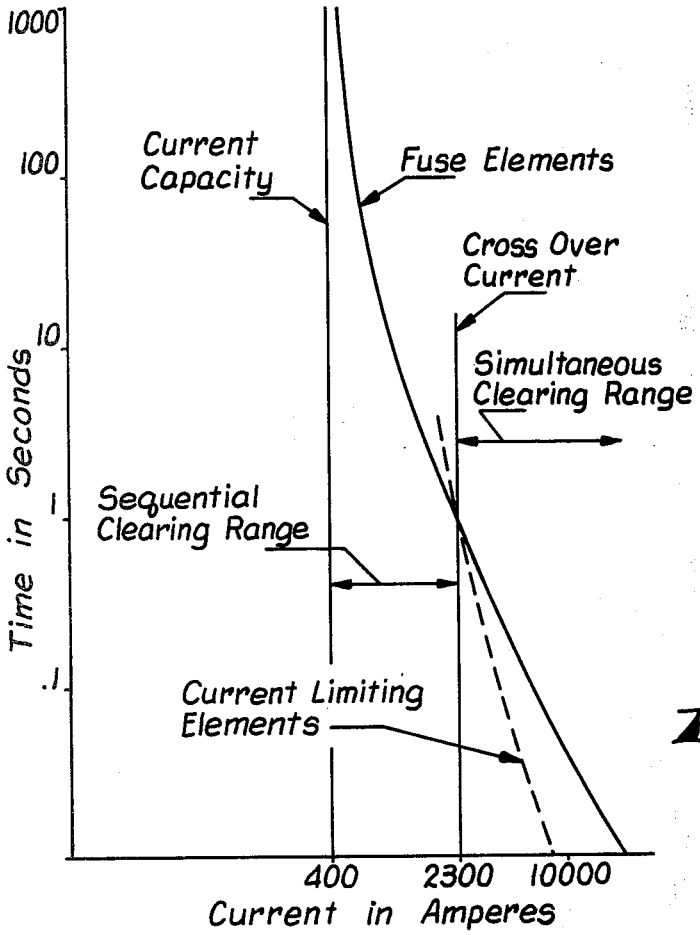
FIG. 8 is a graphical representation showing typical aggregate time current curves for the current limiting elements and the fuse elements of the present invention.

Considering now the graphical representation in FIG. 8, there is shown the collective time-current curves for the current limiting elements 16 and the fuse elements 30 for a 400 amp fuse. Note that in the current range between 400 and 2300 amps, the fuse elements 30 melt before the current limiting elements 16 operate to interrupt the current, whereupon the above described sequential distribution of current through the current limiting elements is initiated. This current range is identified on the graph as the sequential clearing range and corresponds generally to a low fault current range. At currents above 2300 amps, the current limiting elements 16 interrupt the current prior to melting of the fuse elements 30 such that the fuse 10 operates as a conventional current limiting fuse in the high fault current range identified in FIG. 8 as the simultaneous clearing range.

Figure 3:
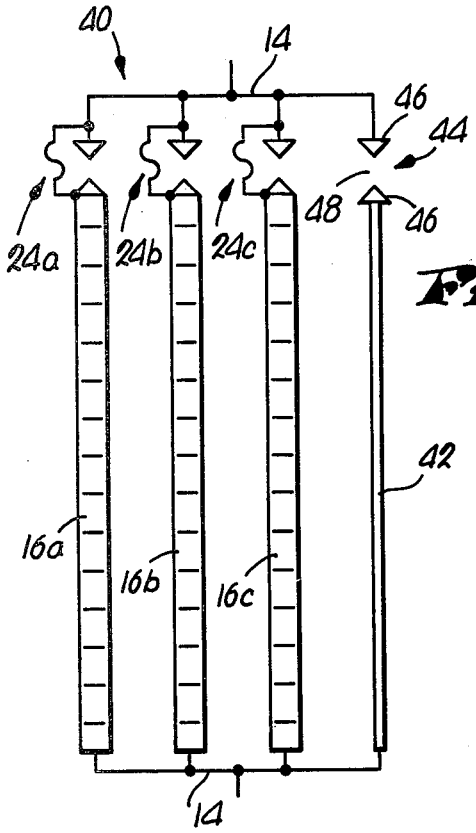
FIG. 3 is a schematic diagram of a second embodiment of the invention wherein one of the arc gaps is wider than the others and is associated with a fusible element.

There is shown in FIG. 3 a second embodiment of the present invention, represented by a full range current limiting fuse 40 substantially identical in construction to the fuse 10 with the exception that fuse 40 is provided with a current limiting element 42 coupled in parallel with the current limiting elements 16. The current limiting element 42 is similar to the elements 16, but has a substantially smaller cross section for a purpose to be described hereinbelow. A gap assembly 44 for the element 42 comprises a pair of spaced points 46 defining an arc gap 48 having a length greater than the arc gaps 26. Unlike the gap assemblies 24, the gap assembly 44 is not initially shunted by a fusible element.

The construction of gap assembly 44 assures that the gap 48 is the last to arc when the fuse 40 is operating in the sequential clearing range as defined in FIG. 8. Hence, the current limiting element 42 predictably is the last element to interrupt inasmuch as the full low range fault current will not be conducted therethrough until after elements 16*a*, 16*b*, and 16*c* have all interrupted the current. By virtue of this construction, the fuse 40 may be constructed utilizing significantly fewer elements 16 than is required for a fuse 10 of similar rating. For example, a 400 amp, 15 kv class fuse 40 could be constructed of eight current limiting elements 16, each having a width of approximately 0.250 inches and a thickness of 0.007 inches, and an additional current limiting element 42. Thus, the fuse 40 would require a total of only nine current limiting elements, as opposed to the sixteen current limiting elements 16 required for a similar rated fuse 10. The significant difference between the two fuses 10 and 40 being the fact that the inclusion of the predictable last to interrupt element 42 allows the use of higher ampacity elements 16, having a minimum interrupting rating greater than the current rating of the fuse 40, and thus requiring fewer elements 16.

Figure 4:
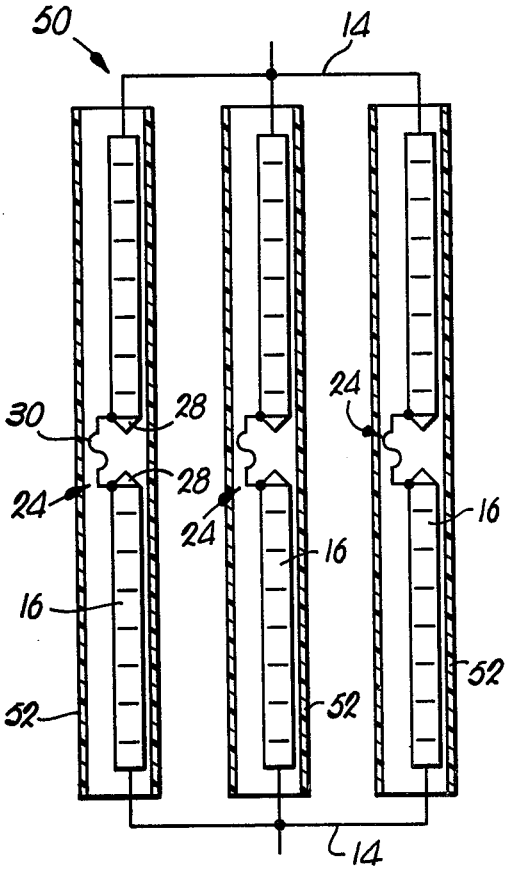
FIG. 4 is a schematic diagram of a third embodiment of the present invention wherein the gaps are disposed intermediate the ends of the current limiting elements and each element is housed within a separate tube.
Figure 5:
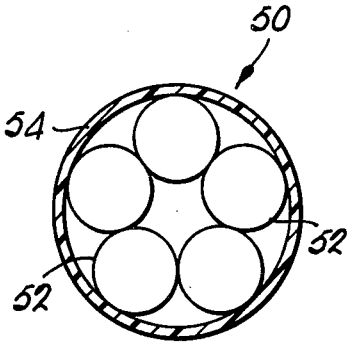
FIG. 5 is a diagrammatic end view representation of the embodiment shown in FIG. 4 wherein the tubes are contained within a cylindrical housing.

Considering now a third embodiment of the present invention as shown in FIG. 4, a full range current limiting fuse 50 is substantially the same as current limiting fuse 10 with the exception that the fused gap assemblies 24 are disposed mid-length of the elements 16 as opposed to being positioned at the ends of the latter as in the preferred embodiment. Moreover, each of the elements 16 in fuse 50 is individually packaged within an elongate tube 52, the tubes 52 being symmetrically arranged within a cylindrical housing 54 as shown for example in FIG. 5. The advantage of the construction of fuse 50 is the fact that it employs the principles of modular construction, it being possible to use the desired number of individually packaged elements 16 to easily construct a fuse 50 particularly tailored to the needs of the circuit being protected.

Figure 6:
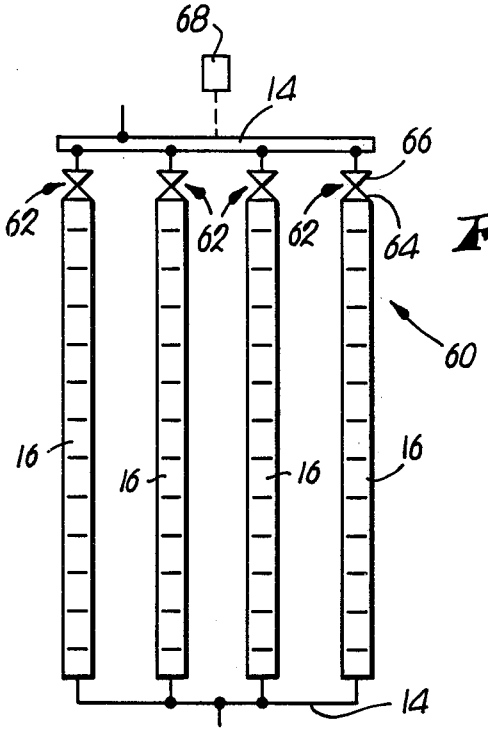
FIG. 6 is a schematic diagram of a fourth embodiment of the present invention wherein the arc gaps are established by a plurality of shiftable contact sets.
Figure 7:
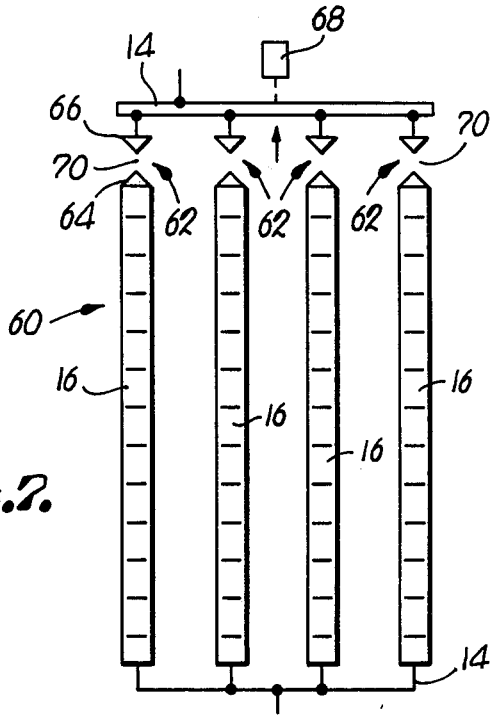
FIG. 7 is a schematic diagram of the embodiment shown in FIG. 6, illustrating the contact set in the open position.

A final embodiment of the present invention is shown in FIGS. 6 and 7 and includes a current limiting fuse 60, again constructed similarly to the fuse 10 with the exception that the fused gap assemblies 24 have been replaced by shiftable contact sets 62 comprising a stationary contact 64 and a moveable contact 66. The moveable contacts 66 are coupled for in unison shifting by a low fault current responsive relay 68. As shown for example in FIG. 6, the contact sets 62 are normally closed to complete a plurality of current paths between the terminals 14. When a low range fault current is sensed by the relay 68, it operates to shift the moveable contacts 66 thereby opening the contact sets 62 simultaneously to define a plurality of arc gaps 70 between the contacts 64, 66. It is contemplated that any other suitable means, such as manual operation or spring loaded temperature sensitive devices, might be employed to accomplish the function of relay 68.

Operation of the fuse 10 is readily apparent from the foregoing description. The fuse 10 is adapted to be interposed in a distribution circuit for the purpose of protecting electrical equipment such as transformers or the like from the deleterious effects of fault currents. When a high range fault current is experienced in the circuit, the fuse 10 operates as a conventional current limiting fuse to effectively and quickly interrupt the current.

On the other hand, when a low range fault current is experienced such that the fuse elements 30 melt prior to operation of the elements 16, the low fault current is sequentially distributed through each of the elements 16 for the purpose of providing reliable interruption of the low fault current. In this regard, simultaneous melting of the elements 30 creates a gap in each of the current paths between terminals 14 defined by the elements 16. These gaps are represented by the arc gaps 26 between points 28.

Shortly after fusing the elements 30, arcing across one or more of the gaps 26 occurs whereby the fault current is conducted by the current limiting elements 16 associated with the arced gaps 26. However, due to the inherent instability of unconstrained parallel arcs, only one of the arcs persist such that the full fault current is carried almost instantaneously by a single element 16. Considering for example FIG. 2, assume that after fusing of the elements 30 arcing occurs across gaps 26*a* and 26*c* such that the full fault current is conducted by elements 16*a* and 16*c*. Almost immediately one of the arcs will take all of the available current thereby causing the other arc to extinguish. Assuming the arc across gap 26*a* persists, the element 16*a* then carrys the full fault current. Inasmuch as the minimum interrupting rating of each element 16 is lower than the current capacity of the fuse 10, the fault current carried by the element 16*a* will be interrupted.

Upon interruption of the current in element 16*a*, the recovery voltage across element 16*a* also exists across gaps 24*b*, *c*, & *d* since elements 16*b*, *c*, & *d* are unfused. Hence, one of the gaps, 24*b*, *c*, or *d*, will breakdown dielectrically, causing the total current to shift to the corresponding element 16, *b*, *c*, or *d*. In this manner, the fault current is sequentially distributed to each of the individual elements 16 until only one of the latter remains. Upon interruption of the current by the last element 16, the fault current has effectively been interrupted by the fuse 10 notwithstanding the fact that the fault current was in the normally difficult to interrupt low fault current range.

Thus it is clear that the present invention provides a full range current interrupting device capable of interrupting high range fault currents with only a minimum of energy dissipation while at the same time able to reliably interrupt troublesome low fault currents. In this regard, note that the basic operation of fuses 50 and 60 is substantially identical to that of fuse 10 as described supra.

Further, the operation of fuse 40 is very similar to that of fuse 10 and has been briefly explained hereinabove. The basic difference between the operation of fuse 40 and fuse 10 is the fact that gap 48 will always be the last to arc such that only the current limiting element 42 need have a minimum interrupting current less than the ampacity of the fuse. In this connection, note that the elements 16*a*, 16*b*, and 16*c* of fuse 40 need only generate sufficient arc voltage to permit arc initiation across the gap 48. Hence, the elements 16 in fuse 40 may have a minimum interrupting rating substantially higher than the current rating of the fuse 40 without affecting the ability of the latter to clear low range fault currents.

In view of the foregoing, it is clear that the present invention offers a significant improvement over the full range current limiting devices heretofore available. By creating parallel arcs initially, rather than forming a single arc in series with parallel arc gaps, the almost insurmountable problem of extinguishing a stable initial arc in favor of subsequent parallel arcs is eliminated. Thus, the present invention offers a degree of reliability unsurpassed by any of the prior art devices, while at the same time being relatively easy and inexpensive to manufacture.

What I claim is:

1. A full range current limiting device comprising:

a pair of spaced terminals adapted to be interposed in an electrical circuit;

a plurality of discrete current limiting elements electrically coupled in parallel between said terminals to define a conductive path therebetween, said current limiting elements being operable collectively to interrupt relatively high current flow through said path exceeding a first predetermined current level and means for establishing an arc gap in series with each of said elements when a relatively low current flow, in an inclusive range between said first current level and a second current level less than said first level, is conducted through said path, said gaps operating to direct the full low current flow between said terminals to individual elements sequentially whereby the latter are successively actuated to interrupt said low current flow, said gap-establishing means comprising a normally closed shiftable contact set for each element and means for opening said contact sets in unison in response to currents within said range.

2. The current limiting device of claim 1, said gaps being of uniform gap length.

3. The current limiting device of claim 1, one of said gaps being longer than all of the other gaps whereby to assure that the one current limiting element associated with said one gap is the last to interrupt the sequentially directed low current flow.

4. The current limiting device of claim 1 or 3, each gap being disposed at one end of a respective current limiting element.

5. The current limiting device of claim 1 or 3, each gap being disposed intermediate the ends of a respective current limiting element.

6. The current limiting device of claim 3, said one current limiting element being adapted to interrupt at a current level lower than the others of said current limiting elements.

7. The current limiting device of claim 1; and a housing for said current limiting elements, there being a quantity of pulverulent arc-suppressing material within said housing in close proximal relation to the current limiting elements.

8. The current limiting device of claim 7; said current limiting elements being helically wound around a cylindrical dielectric core member, said material being disposed within the space between the wall of said housing and said core member.

9. The current limiting device of claim 8, said core member being concentric with said housing.

10. The current limiting device of claim 1, each of said current limiting elements being disposed within an elongate tube, said tubes being contained within a cylindrical housing.

11. The current limiting device of claim 10, said tubes each containing an amount of pulverulent arc-suppressing material in close proximal relation to said elements.

12. The current limiting device of claim 1, said gap-establishing means including a separate chamber for each gap, said chambers being of substantially uniform dimension.

13. The current limiting device of claim 12, said chambers being cylindrical and symmetrically arranged.

14. The current limiting device of claim 12, said chambers being disposed immediately adjacent one of said terminals.

15. A full range, electrical current limiting and fusing device comprising:

a pair of terminals adapted to be interposed in series with an electrical circuit;

a plurality of current limiting and fusing assemblies electrically coupled in parallel with each other and in series between said terminals, each of said assemblies including means establishing an arc gap and a current limiting fuse element coupled in series with said gap-establishing means, the portion of said assemblies electrically disposed in series between said gap-establishing means and said current limiting fuse element thereof being electrically isolated from the corresponding portion of each of the other of said assemblies; and means for normally electrically bridging at least certain of said gap-establishing means under conditions of normal current flow between said terminals, said bridging means including structure for removing said bridging and permitting initiation of one or more electrical arcs across said gap-establishing means under the influence of certain lower current portions of the full range of fault conditions experienced by said circuit, said current limiting fuse elements serving to interrupt current flow by fusing under the full range of fault conditions experienced by said circuits.

16. The invention of claim 15 wherein said electrical bridging means comprises low current sensitive fuse means coupled in shunt with said gap-establishing means of said assemblies.

17. The invention of claim 16 wherein said fuse means comprises a low current sensitive fuse member for each of said assemblies respectively electrically coupled in shunt with said gap-establishing means of the latter.

18. The invention of claim 15, one of said gaps being longer than all of the other gaps, said longer gap being unbridged, whereby to assure that the one current limiting element associated with said one gap is the last to interrupt the sequentially directed low current flow.

19. The invention of claim 18, said one current limiting element being adapted to interrupt at a current level lower than the others of said current limiting elements.

* * * * *